US006296058B1

(12) United States Patent
Brieger

(10) Patent No.: US 6,296,058 B1
(45) Date of Patent: Oct. 2, 2001

(54) WELLBOTTOM FLUID IMPLOSION TREATMENT SYSTEM

(76) Inventor: Emmet F. Brieger, HC 67 Box 58, Nogal, NM (US) 88341

( * ) Notice: Subject to any disclaimer, the term of this patent is extended or adjusted under 35 U.S.C. 154(b) by 0 days.

(21) Appl. No.: 09/526,179

(22) Filed: Mar. 15, 2000

(51) Int. Cl.[7] ..... E21B 21/00; E21B 43/16; E21B 34/08

(52) U.S. Cl. ..... 166/311; 166/63; 166/299; 166/319; 166/373

(58) Field of Search ..... 166/299, 311, 166/63, 319, 320, 332.2, 120, 126, 133, 373

(56) References Cited

U.S. PATENT DOCUMENTS 3,712,378 * 1/1973 Olivier ..... 166/299
3,743,021 * 7/1973 McCauley et al. ..... 166/311
4,185,690 * 1/1980 Kinney ..... 166/813
4,285,402 * 8/1981 Brieger ..... 166/311
4,529,038 * 7/1985 Brieger ..... 166/312

* cited by examiner

*Primary Examiner*—David Bagnell
*Assistant Examiner*—Jennifer Dougherty
(74) *Attorney, Agent, or Firm*—Marvin J. Marnock

(57) ABSTRACT

A system for inducing implosion shock forces on perforation traversing earth formations with fluid pressure where an implosion tool is selected relative to a shut in well pressure and a tubing pressure to have a large and small area piston relationship in a well tool so that at a predetermined tubing pressure the pistons move a sufficient distance to open an implosion valve which permits a sudden release of well fluid pressure into the tubing string and produces an implosion force on the perforations. A pressure gauge on the well tool records tubing pressure and well pressure as a function of time.

15 Claims, 5 Drawing Sheets

WELLBOTTOM FLUID IMPLOSION TREATMENT SYSTEM

GOVERNMENT RIGHTS

This invention was made with Government support under Contract Number DE-FG36-99GO10446 awarded by the United States Department of Energy. The Government has certain rights in the invention.

FIELD OF THE INVENTION

This invention relates to a system for stimulation of oil and gas production from an oil or gas well which traverses earth formation and has been completed with shaped change perforations. More particularly, the system of the invention is used to develop a sudden differential of pressure shock effect in perforations in a well bore to flow or flush debris and compacted materials from the perforations with a relatively low shock effect in the tool.

BACKGROUND OF THE INVENTION

Prior Art

U.S. Pat. No. 4,142,583 issued Mar. 6, 1979 describes a shock tool for producing a differential pressure across perforations. The tool is lowered through a tubing string on a wire line and, at a selected level, the wire line connection to the tool is released so that a pressure differential sets a pack off means to close off the cross-section of the tubing string. The fluid in the bore of the tubing string is removed thereby creating a pressure differential across the tool. Next, a sinker bar is dropped from the surface through the tubing to operate a shear pin release whereby the pack off means is released and the perforations are subject to the differential pressure across the tool which provides a back flow on the perforations. Release of the pack off means permits the tool to irretrievably drop to the bottom of the well bore.

Some of the disadvantages of the above system are readily apparent. The tool becomes junk in the well and is not reusable. Also, the exact differential pressure acting on the perforation is imprecise because it depends upon the fluid removal above the tool and is not easily measured or calculated.

U.S. Pat. No. 4,285,402 issued Aug. 25, 1981 also discloses a system for cleaning perforations by differential pressures. In this system, a tool is lowered through a tubing string on a pipe. A manifold at the surface controls this pressure in the pipe and in the tubing string. A packer on the tool is sealed and locked in the tubing. The tool has a bypass passageway normally closed off by a piston which is held in place by a shear pin. FIG. 3 shows a packer variation for seating in a seating nipple. FIG. 4 shows a packer variation and a latching piston mechanism. FIG. 5 shows a landing groove in a tubing string and locking keys for a latching mechanism. In all of the various configurations, a piston is shear pinned in place and when a predetermined differential reaches a force sufficient to shear the shear pin, the piston is released to open a bypass and apply a sudden pressure differential across the perforations. Subsequently, the tool is released by straight up retrieval (FIG. 3) or by pressure control (FIG. 4) or by a retrieving tool (FIG. 6) while the above system is retrievable, its useful life is quite limited because the impact of the suddenly released piston in the tool damages the tool requiring expensive reworking. Also, while the shear pin release can be reasonably calculated it is imprecise as to when the release will occur.

SUMMARY OF THE PRESENT INVENTION

In the present invention, the various embodiments embody the concept of shifting a valve sleeve in a well tool by use of an actuator which is responsive to a predetermined differential pressure between the pressure of fluid in the tubing string and shut in pressure of fluids in a well bore.

By controlling the predetermined differential pressure (by selecting an appropriate piston area relationship) the shut-in pressure relationship to the tubing pressure is related and a valve in the well tool can be opened at a predetermined pressure in the tubing string. When the valve is opened, the shut-in pressure is effectively released suddenly without severe damage to the well tool so that the life of the tool and re-dressing time are improved.

In a first embodiment, a large piston area in a well tool has fluid access to the pressure in a tubing string while a small piston area has fluid access to the pressure in the well bore. When the pressure in the tubing string is reduced to a predetermined amount as determined by the area relationship of the pistons and the shut in pressure, the pistons move a valve sleeve and open valve access ports so that an implosion effect occurs in the perforations in the well bore.

The relationship of the piston areas can be changed by use of a replaceable sleeve with a different piston area.

In a second embodiment, the large piston is provided with upwardly extending latching fingers normally located midway of a valve sleeve. When the pressure in the tubing string is reduced, the pistons move upwardly to latch the fingers to the upper end of the valve sleeve. When the tubing pressure is then increased, the valve sleeve is moved to open the valve access ports so that the implosion effect occurs.

In a third embodiment the small piston is provided with downwardly extending latching fingers normally located in the small piston cylinder bore. The valve sleeve is connected to the large piston and has multiple O-ring seals. When the tubing pressure is decreased (as in the first embodiment) the valve access ports are opened and the lower O-ring is blown out of its sealing groove. The latching fingers latch into a latching groove. When the tubing pressure is increased to overcome the force of the latching fingers and the piston area relationships, the valve is closed. Thereafter the operation can be repeated and stripping an O-ring on each operation.

In a fourth embodiment, a brass ring shock absorber is located above the valve sleeve. The valve sleeve is normally latched in a closed position by collet fingers. By reducing the pressure in the tubing string the collet fingers and the valve sleeve move upwardly to a position where the collet fingers unlock the valve sleeve so that the valve sleeve opens the access ports and the brass ring absorbs the shock impact of the valve sleeve in the tool.

DESCRIPTION OF THE INVENTION

Figure 1:
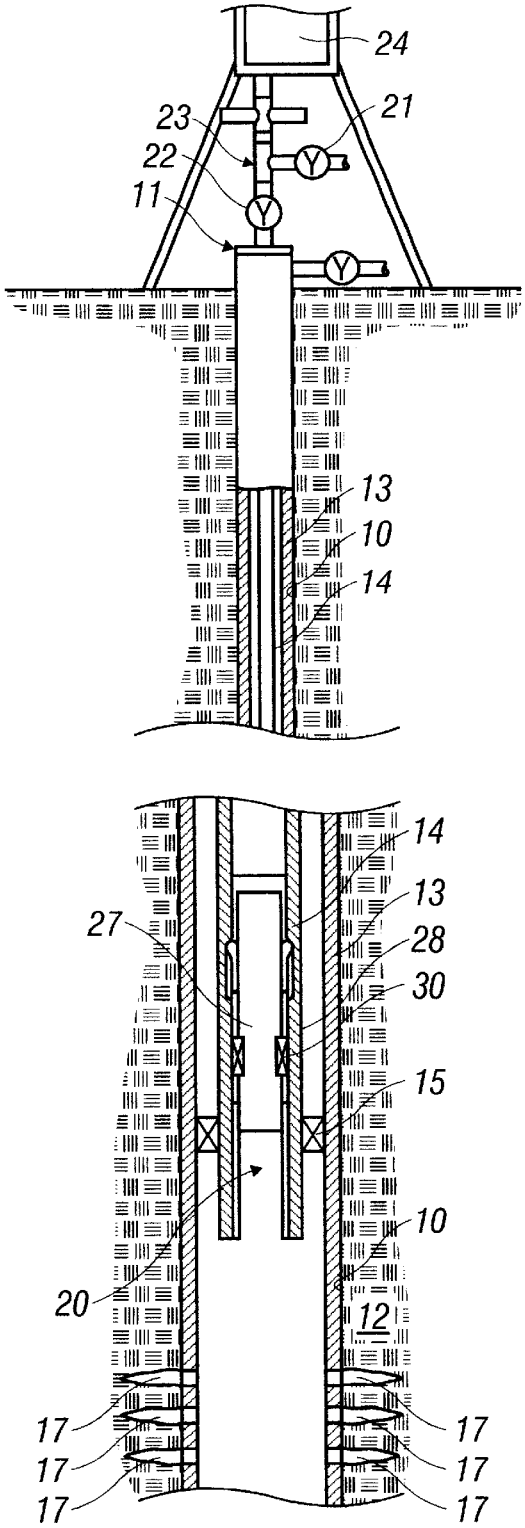
FIG. 1 is a schematic representation of the overall environment for use of the present invention.

In FIG. 1, a well bore 10 extends from wellhead 11 to an underground hydrocarbon or fluid producing formations 12. The well bore 10 is defined in part by casing string 13 which is cemented in place. A tubing string 14 extends from the earth's surface to a location proximate to the producing formations 12. A well packer 15 at the lower end of the tubing string forms a fluid isolation barrier between the tubing string 14 and the casing 13 to direct fluid flow from the producing formations to the earth's surface via the tubing string 14. Perforations 17 extend through the casing 13 below the production packer 15 and into the formations 12. The perforations 17 allow fluid communication between the bore of the casing 13 and the formations 12 adjacent thereto.

Well perforations 17 typically are plugged by residue or debris from explosive shaped charges which are typically used to produce the perforations. The shaped charge jet particles traveling at 20,000 feet per second crush the formation into compacted low permeability fines surrounding the penetration (perforation tunnel). Additionally, the perforation tunnel is filled with compacted low permeability fines from the shaped charge itself. A finite differential pressure is necessary to start flow from the perforations. Some perforations may require less than 200 psi, some perforations may require more than 500 psi. As casing pressure is reduced, some perforations will start flowing. As the casing pressure then increases, the formation pressure decreases to a flowing pressure, hence the differential pressure is reduced. Thus, the majority of the perforations are never subjected to sufficient differential pressure to start flow, and they remain plugged and non-producing for ever. The present invention involves a system to clean deposits and debris from the perforations by inducing an implosion effect of formation fluids to back flush the perforations using pressure of the formation fluids. The wells with plugged perforations are identifiable and are serviced without pulling tubing. Formation fluid is made to "implode" into the casing, carrying with it debris and compaction from the plugged perforation tunnels within the formation, thus causing these perforations to start flowing for the first time. Thus the well production rate is dramatically increased. Explosives or chemicals are not involved. It is all mechanical and hydraulic. The wellhead 11 at the earth's surface permits conventional wireline servicing techniques to be used to install and retrieve well tools 20, which contain alternative embodiments of the present invention, as well as perform certain pressure control conditions on a well tool. Well tools 20 and pressure control techniques will be described later in more detail.

At the wellhead 11 are valve 21 and master valve 22 to isolate fluids from a Christmas tree 23 on top of wellhead 11. Various conventional service units 24 for pressure control techniques can be used with the present invention as will be apparent from the description to follow.

Figure 2:
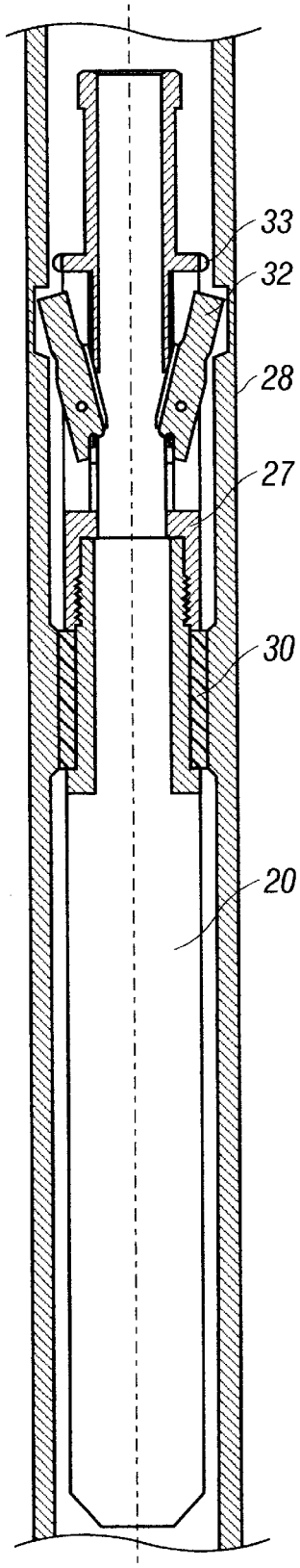
FIG. 2 is a view in partial cross-section of a conventional latching assembly.

Apparatus including well tool 20 for cleaning downhole perforations 17 is shown in FIG. 1. A selectively releasable locking mandrel 27 provides means for releasably anchoring the apparatus at a downhole location in the tubing string 14. A landing nipple 28 which comprises an integral part of tubing string 14 defines a downhole location proximate to perforations to be cleaned. A conventional locking mandrel 27 and landing nipple 28 satisfactory for use with the 20 present invention are shown in FIG. 2.

Seal means 30 are carried on the exterior of locking mandrel 27 to establish a fluid isolation barrier between an interior bore of landing nipple 28 and the bore of the locking mandrel 27. Keys or dogs 32, carried by locking mandrel 27, can be releasably engaged with a locking groove 33 on the interior of landing nipple 28. The well tool 20 is set and retrieved in a conventional manner. The locking mandrel 27 and landing nipple 28 being conventional will not be illustrated in the description and illustration of the well tool 20 and various embodiments of the well tool to follow.

Figure 3:
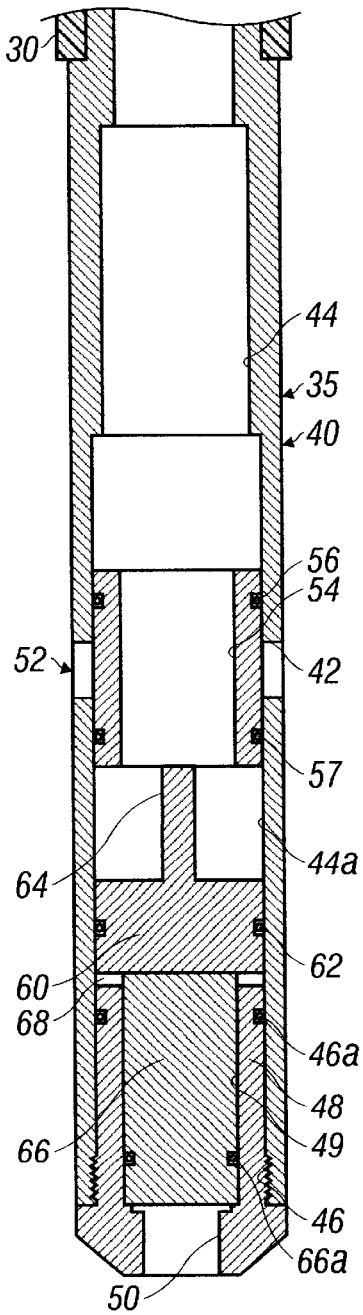
FIGS. 3–4 are views in cross-section of an embodiment of the invention respectively in a closed and open condition.
Figure 4:
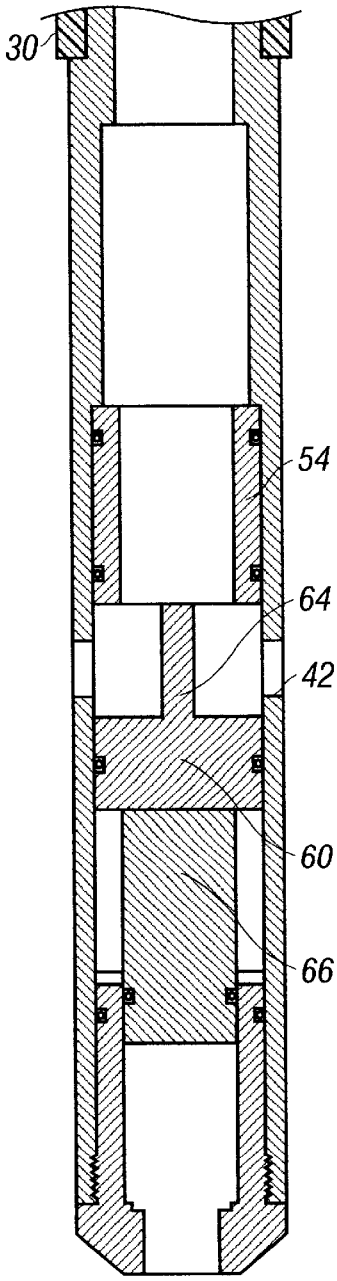

Apparatus for cleaning well perforations 17 using an embodiment of the present invention is shown in FIGS. 3–4. The well tool 35 can be attached to locking mandrel 27 by a suitable connection. Only the lower end of the tool below the seal 30 and dogs 32 (see FIG. 2) are illustrated in the drawings to follow for ease of presentation.

In the embodiment of the present invention illustrated in FIGS. 3 and 4, an elongated tubular tool body 40 carries standard outer packing glands 30 and is sized for passage through the tubing string. At the upper end of the tool body 40 is a standard overshot anchor assembly with locking lugs (SEE FIG. 2) for selective locking engagement with a latching groove in a landing nipple which is located in the tubing string.

At the lower end of the tool body 40 are a series of peripherally arranged flow access openings 42 which can place fluid exterior of the tool body 40 in fluid communication with a central bore 44 in the tool body 40. The central bore 44 has an enlarged diameter portion defining a bore 44*a* extending to a threaded terminal end 46 which is coupled to a piston housing 48 with a piston bore 49 and a smaller fluid access bore 50. An O-ring 46*a* provides a seal with respect to the bore 44*a*. The tool body 40 has a valve 52 which is defined by the access openings 42 and a tubular valve sleeve 54 which extends over the flow access openings 42 in a normally closed position of the valve. Spaced apart sealing means 56 and 57 between the valve sleeve 54 and the bore 44*a* provide a pressure balance for the valve sleeve 54 in a closed position of the valve. Located below the valve sleeve 54 is a large piston 60 slidable in the bore 44*a* in the tool body. The piston 60 has an O-ring seal 62. The piston 60 has a central, upwardly extending projection 64 which engages the downwardly facing wall of the valve sleeve 54 at diametrically opposite locations. A pressure sealing means 62 on the large piston 60 defines a large pressure area $A_2$ which is open to the interior of the tool body.

Below the large piston 60 is the tubular piston housing 48 with a smaller diameter bore 49 with respect to the bore 44*a* and a smaller piston 66 with a sealing means 66*a*. The access bore 50 is open to the exterior of the tool body below the sealing means 66*a*. The space 68 between the large piston 62 and the small piston 66 is at atmospheric pressure.

When the tool is made up, the sealing means 62 define an area $A_2$ of the large piston 60 and the sealing means 66*a* defines an area $A_1$ of the small piston 66. When the tool is disposed in the tubing string, there is a shut in pressure $P_1$ of the well fluids below the tool 40 and while the bore 44*a* of the tool is closed off by the valve sleeve 54. There is a tubing pressure of fluid located in the tubing string above the tool when the valve is closed. The valve sleeve 54 prevents fluid communication between the interior of the tubing string and the well bore below the tool. For any given shut in pressure, the fixed areas $A_2$ and $A_1$ of the large and small pistons 60 and 66 define a corresponding tubing pressure $P_2$ for a given shut in pressure which will permit the pistons to move the valve sleeve 54 to an open position.

The differential pressure ΔP required to open the valve sleeve 54 in the tool is the difference in pressure between the shut in pressure $P_1$ and the tubing pressure $P_2$ after bleeding off the fluid column above the valve sleeve to a tubing pressure where the differential pressure moves the pistons and the valve sleeve to an open position.

The equation for the required differential pressure is $$\Delta P = P_1 - P_2$$

and $$P_2 = P_1 A_1 / A_2$$

where $P_1$ is the shut in pressure.

Thus with the tool locked in place in a tubing string and a known shut in pressure and a known fluid column pressure, the fluid column pressure can be reduced in any suitable manner and at the preset differential pressure ΔP, the pistons move the valve sleeve to a location where the access openings are unblocked and the valve sleeve then suddenly opens in response to the applied shut-in pressure. The sudden opening of the valve 52 causes an intense upward fluid surge in the fluids in the tubing string from sudden release of pressure of the shut in fluids to the low pressure in the tubing string. The sudden release of pressure of the shut in fluids to a lower pressure in the tubing string causes an implosion effect in the well perforations from the outward flow of fluid under pressure from the fluids in the formations. In the tool the pressure balanced valve sleeve is not damaged in the movement to open the valve.

The operating procedure involves seating the tool in the tubing string and removing the desired amount of pressure and fluid from the tubing string. This can be done in various ways. For example:

a) bleeding off the surface pressure if this is sufficient to operate the tool;

b) lowering the fluid column in the tubing string with coiled tubing and nitrogen and then bleed off the nitrogen pressure to the ΔP to operate the tool; or c) pushing fluid in the tubing back into the formation with nitrogen prior to setting the tool, then setting the tool in the tubing string and bleeding off the nitrogen pressure from the tubing to the selected ΔP;

d) utilizing the gas lift installation, where available, to remove fluid from the tubing to achieve the selected ΔP.

Figure 5:
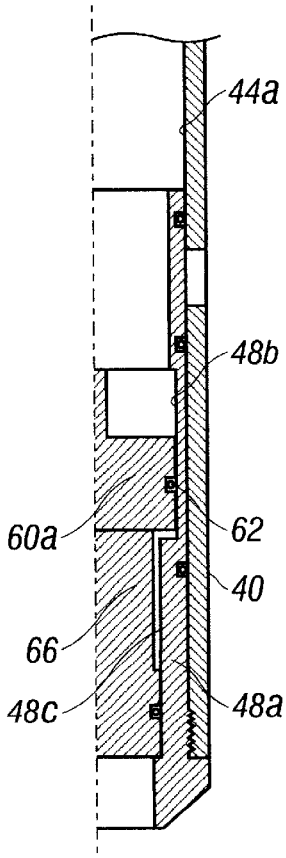
FIG. 5 is a partial view in cross-section of a modification to change piston area relationships.

As shown in FIG. 5, the Area $A_2$ and $A_1$ relationship can be changed by a piston housing 48*a* having stepped diameter portions 48*c*, 48*b*. The diameter 48*b* is less than the diameter 44*a*. By sizing the area relationship between the seal on the large piston 60*a* and the small piston 66 the differential pressure required to open a valve sleeve can be adjusted. It should be noted that the piston ratios can be changed by changing only one of the piston diameters. For example, the I.D. of 48 and O.D. of 66 can be changed, and the diameters of 44*a* and 60 left unchanged.

Figure 6:
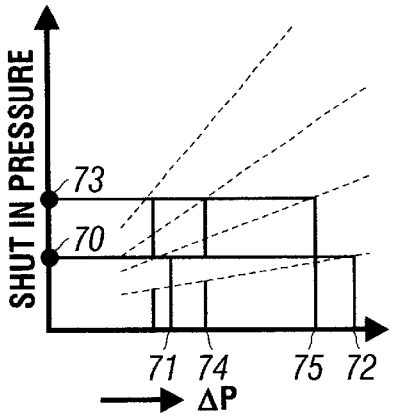
FIG. 6 is a plot of differential pressures $\Delta P$ versus shut in pressures to show plots of four different piston area relationships.

With a defined area relationship, as shown in FIG. 6, for a given shut-in pressure 70, the operator can select the desired implosion pressure 71 (ΔP) and the tubing pressure required to open a valve. At the same shut in pressure a higher ΔP (72) can be chosen with a different piston ratio. The point 73 is at a different shut-in pressure with different ΔP's shown by points 74 and 75 using different piston ratios. The required tubing pressure is determined by subtracting the selected ΔP from the actual shut in pressure.

The above system has some limitations in that an operator may not desire to swab out fluid in the tubing string because opening of the tool could cause the swab line to be blown up the tubing string and tangled. Also, a tool can not be run in the well bore attached to "dry" or partially filled tubing (which is sometimes desirable) because the tool will open prematurely.

Figure 7:
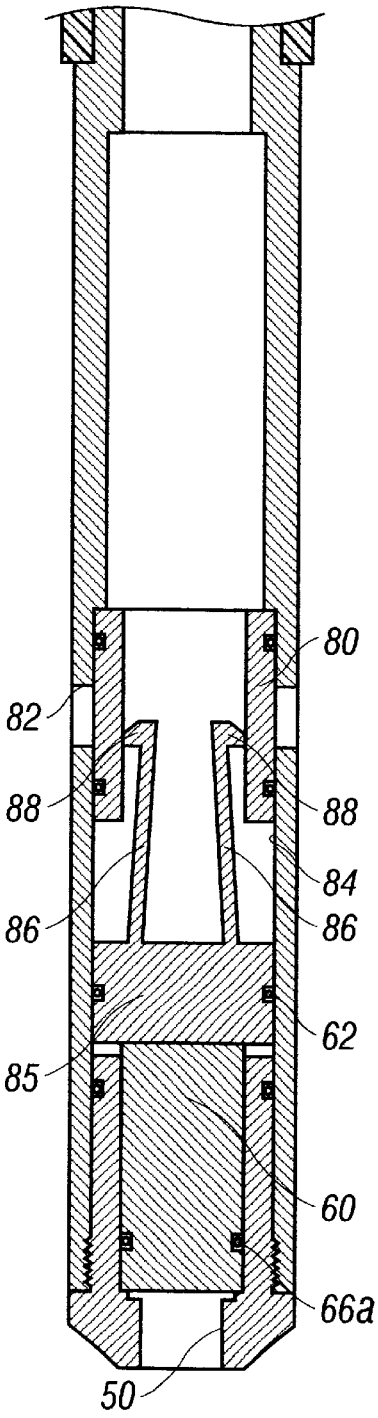
FIGS. 7–9 are views in cross-section of another embodiment of the present invention in various operating conditions.
Figure 8:
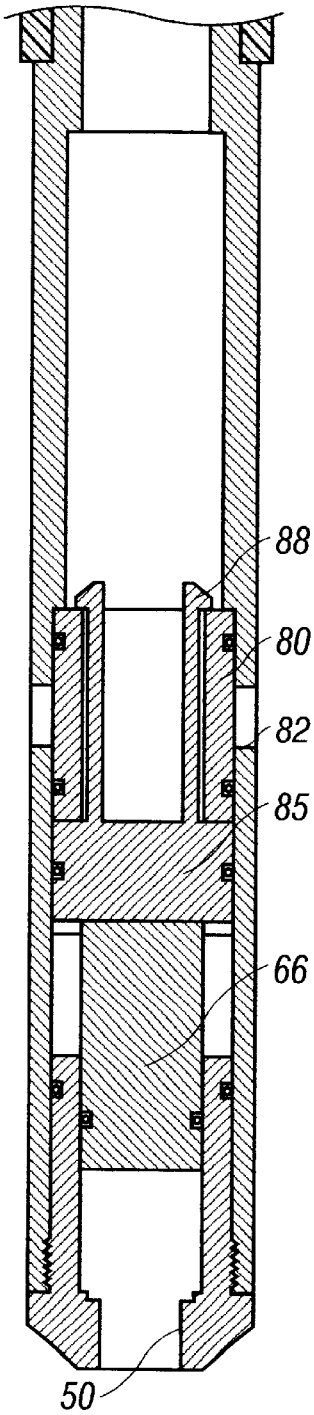
Figure 9:
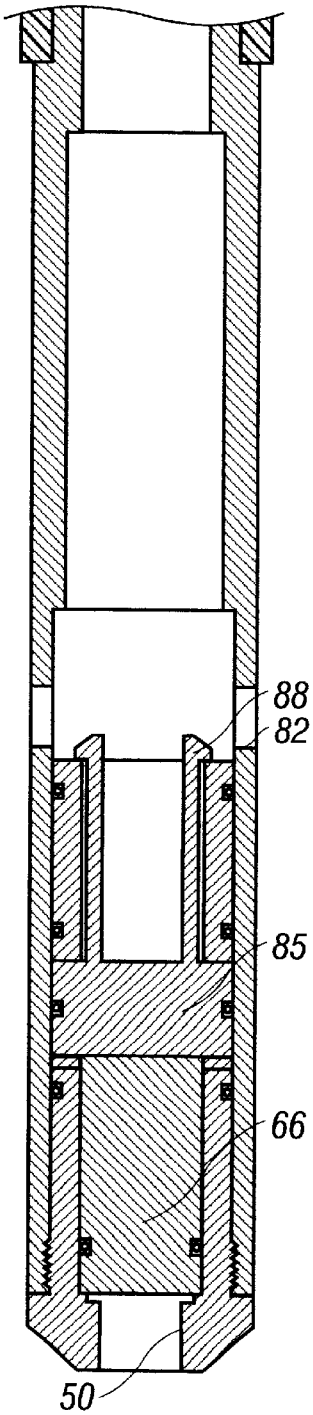

In the tool construction shown in FIG. 7, a valve sleeve 80 is initially located across the access openings 82 at the upper end of an enlarged bore 84. The large piston 85 in the bore 84 has upwardly extending collet fingers 86 with locking ends 88. The fingers 86 are circumferentially spaced about the body of the piston and the locking ends 88 are normally located midway of the valve sleeve. The fingers 86 are normally resiliently biased outwardly. The number of these fingers can be only two, located at 180° circumferentially from each other.

After the tool is positioned in the landing nipple there are alternate choices for operating the equipment. The operating procedure is similar in setting the tool in the tubing string and removing the desired amount of pressure and fluid. This can be done by steps a-d described above and additionally e) fluid in the tubing string can be swabbed out by a swabbing unit in a conventional manner to the desired ΔP.

At the present ΔP, the pistons 66, 85 move up to a cocked position where the collet fingers 88 latch onto the upper end of the valve sleeve 80. Then the tool valve is actuated as follows:

1*a*) for step a above, the well is shut in and surface pressure is applied to the tubing string;

2*b*, 2*c*, 2*e*) for steps b,c, & e above fluid is dumped back into the tubing string to the desired ΔP; or

2*d*) the well is shut in and pressure is built up to the ΔP by lift gas injected back into the tubing string.

Thus, pressure is increased slightly in the tubing string to move the pistons downwardly until the valve sleeve 80 uncovers the access ports 82 where the shut-in pressure flows into the tubing string and produces an implosion effect on the perforations.

Figure 10:
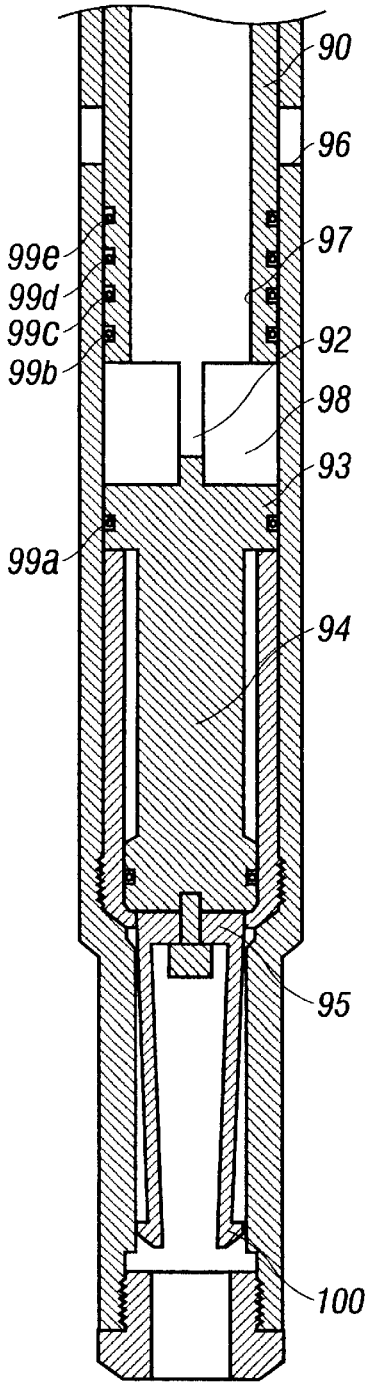
FIGS. 10 & 11 are views in partial cross-section of another embodiment of the present invention which permits multiple operations.
Figure 11:
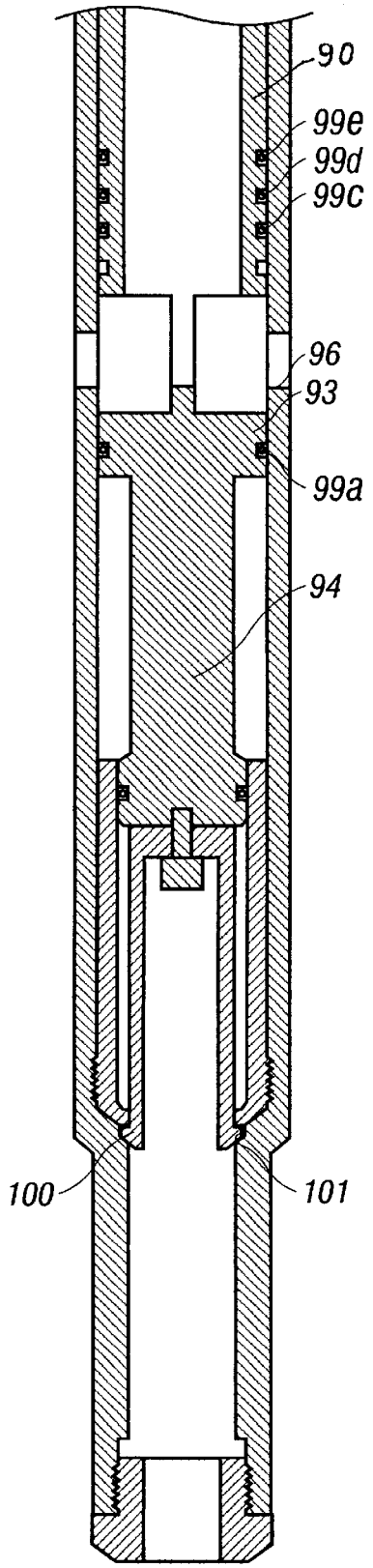

Referring now to FIGS. 10 & 11, a tool is illustrated which can be used multiple times without retrieving and re-running as contrasted to a single action of the tool. A slidable valve unit includes tubular valve sleeve portion 90 connected by peripheral straps 92 to a large piston portion 93. The piston portion 93 has a lower small piston 94 and an attached spring finger collet member 95. The valve unit slidably disposed in the body member where the valve sleeve portion 90 closes the access openings 96. The valve unit has a solid cross section at the large piston portion 93 and a blind bore 97 extending to window openings 98 located above the large piston portion 93. Between the window openings 98 and the end of the valve sleeve portion 90 are spaced apart sealing elements 99*a*, 99*b* which normally straddle the access openings. Just above the windows are additional sealing elements 99*c*, 99*d*, 99*e*.

In operation, when the tool is operated by reducing the pressure in the tubing string the valve unit is shifted upwardly to open the access openings 96 and the fingers on the collet member 95 have latch ends 100 received in a latching groove 101 in the body member. In this step, the lower O-ring 99*b* is normally blown out. Next, the pressure in the tubing string is increased by shutting in the wall or by one of the procedures previously described to a level where the retaining force on the latch ends 100 in the latching groove 101 plus the upward force of the small piston 94 are overcome by piston 93 and the valve body member is shifted downwardly to reset the tool. Thereafter, the pressure in the tubing string is reduced to operate the tool again and the next lower O-ring 99*c* is blown out. The retaining force of the latch ends 100 can be set to any required amount. This force is necessary in order to prevent the piston from closing the sleeve prematurely when the tubing pressure is increased and the casing pressure decreased at opening.

The operating procedure is similar in setting the tool in the tubing string and remove fluid by one of the procedures a–d above. By repeating the operation, the second seal will be blown out and the valve again closed, setting up the tool for a third and fourth repeat operation. The small piston 66 is positioned below the large piston in a manner similar to that described with respect to FIG. 3.

Figure 12:
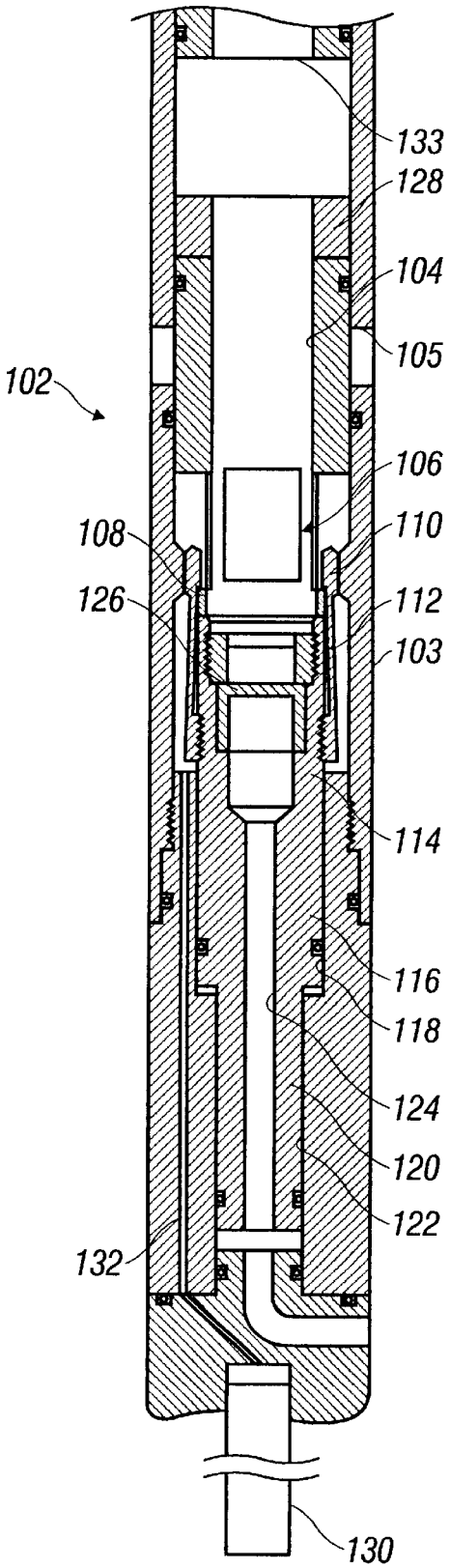
FIGS. 12 & 13 are views in partial cross-section of another embodiment of the present invention.
Figure 13:
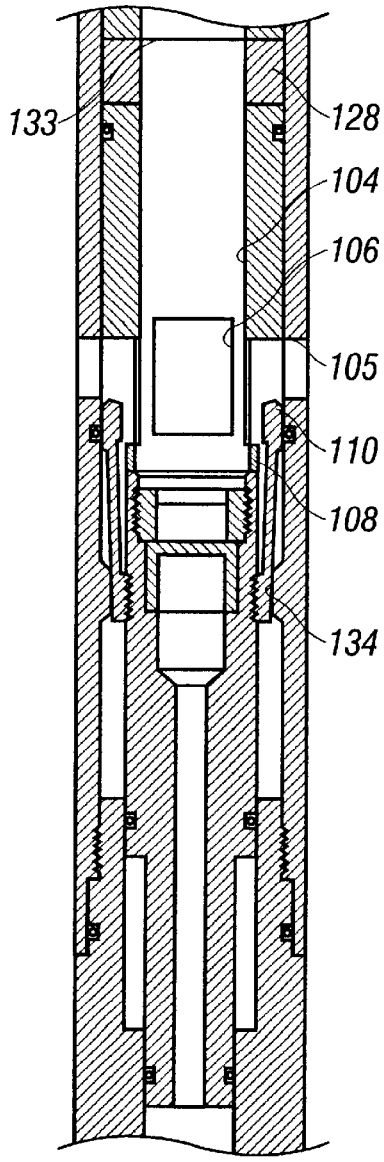

Referring now to FIGS. 12 & 13, a tool 102 has access ports 105 normally closed by a valve sleeve 104. The valve sleeve 104 has lower access windows 106 and a tubular lower locking section 108. The locking section 108 is engaged by locking lugs 110 on collet fingers 112.

The collet fingers 112 are peripherally spaced about a piston member 114 and may number only 2 at 180°. The piston member 114 has a larger diameter portion 116 received in a large diameter bore 118 and a small diameter portion 120 received in a small diameter bore 122. A central bore 124 is closed off by a rupture disc 126. Above the valve sleeve 104 is an annular ring 128 of half hard brass which provides a cushion to absorb impact forces on the valve sleeve. This permits the valve sleeve to be reused many times before replacing.

At the lower end of the tool is a conventional oil well type pressure gauge 130 such as a SPARTEK gauge which can record downhole tubing and well bore pressures independently as a function of time. A flow passageway 132 connects the gauge to the tubing string while the lower end of the gauge is coupled to fluid in the well bore. At the upper end of the tool is a tubular cross over 133 for connecting to the latching mechanism. The pressure gauge records the tubing pressure and the well bore pressure independently before opening the implosion valve and after opening the implosion valve.

When the pressure is reduced in the tubing string at the predetermined $\Delta P$, the piston 114 moves upwardly moving the back surfaces of the locking keys 110 off of an annular locking projection 134 in the tubing bore which releases the spring biased locking keys from engagement with the windows 106 and the valve sleeve 104 moves upwardly to open the access openings 105 and develop the implosion force across the perforations. The pressure gauge obtains recordings of pressure versus time for the tubing string and the well bore.

In retrieving the tool, the valve sleeve 104 may move down but the access openings 105 are kept open by engagement of the ring 108 with the top of the keys 110. The keys 110 move downwardly under the ring when the piston 116 is moved down. In the event the sleeve fails to open, the disc 126 is ruptured in a conventional manner to equalize the pressure of the tubing to the formation fluid pressure and the tool latching mechanism can be released and the tool retrieved.

It will be apparent to those skilled in the art that various changes may be made in the invention without departing from the spirit and scope thereof and therefore the invention is not limited by that which is disclosed in the drawings and specifications but only as indicated in the appended claims.

What is claimed is:

1. Apparatus for use in a well bore for cleaning perforations traversing earth formations containing hydrocarbons under pressure and having a tubing string extending to a location proximate to the perforations and sealed with respect to the bore of the well; said apparatus including an implosion tool having selectively operable latching means for releasably locking the implosion tool in the tubing string, said implosion tool having a longitudinally extending flow passage;

access ports in said tool for placing said flow passage in fluid communication with the exterior of the tool, a slidable valve sleeve disposed in said flow passage over said access ports and being pressure balanced in said flow passage, said access ports and said valve sleeve constituting an implosion valve;

a large piston and a small piston slidably disposed in bores in said tool where the large piston is cooperable with said valve sleeve and the smaller piston is cooperable with said large piston, said large piston being in fluid communication with said flow passage and said small piston being in fluid communication with the formation pressure below the tool, said large piston and said small piston having an area relationship so that a predetermined tubing pressure with respect to a given shut in pressure can be used in moving said valve sleeve and in opening said access ports, and whereby said valve sleeve can be moved to open said access ports by controlling the pressure in the tubing string with respect to the shut in pressure of the well to develop an implosion fluid flow from the perforations when said access ports are first opened.

2. The apparatus as set forth in claim 1 wherein at least one of said bores for said large piston and said small piston is contained in a replaceable sleeve member in the tool.

3. The apparatus as set forth in claim 2 wherein each of said bores is contained in the replaceable sleeve member in the tool.

4. The apparatus as set forth in claim 1 wherein one of said pistons has spring biased collet members with latching keys for engaging said implosion valve in an open or closed condition of the implosion valve, said pistons, upon changing the pressure relationship between the pressure in the tubing string to the pressure in the well bore, moving said implosion valve to an opposite condition of the valve.

5. The apparatus as set forth in claim 4 wherein said collet fingers and said valve sleeve are proportioned so that said latching keys go from a neutral position in a valve sleeve to an engaging condition at the top of the valve sleeve.

6. The apparatus as set forth in claim 4 wherein said collet fingers cooperate with said tool to lock the valve sleeve in a closed condition and releases when the pressure relationship changes to a predetermined parameter and moves the pistons.

7. The apparatus as set forth in claim 6 wherein said valve sleeve has a malleable shock absorbing ring disposed between it and an engagement surface.

8. The apparatus as set forth in claim 6 including a frangible disc in a central bore of the tool for use in equalizing pressure in the bore of the tool.

9. Apparatus as set forth in claim 4 wherein said valve sleeve has lengthwise spaced sealing rings which can be individually blown out for multiple operation of the tool.

10. The apparatus as set forth in claim 1 and further including a pressure gauge for measuring and recording pressure as a function of time, said pressure gauge being coupled to the interior of the flow passage in the tool and to the well bore below the tool so as to measure pressure in the tubing string and in the well bore as a function of time.

11. Apparatus for use in a well bore for cleaning perforations traversing earth formations containing hydrocarbons under pressure and having a tubing string extending to a location proximate to the perforations and sealed with respect to the bore of the well; said apparatus including an implosion tool having selectively operable latching means for releasably locking the implosion tool in the tubing string, said implosion tool having a longitudinally extending flow passage;

access ports in said tool for placing said flow passage in fluid communication with the exterior of the tool, a slidable valve sleeve disposed in said flow passage over said access ports and being pressure balanced in said flow passage, said access ports and said valve sleeve constituting an implosion valve;

a large piston and a small piston slidably disposed in bores in said tool where the large piston is cooperable with said valve sleeve and the smaller piston is cooperable with said large piston, said large piston being in fluid communication with said flow passage and said small piston being in fluid communication with the formation pressure below the tool, said large piston and said small piston having an area relationship so that a predetermined tubing pressure with respect to a given shut in pressure can be used in moving said valve sleeve and in opening said access ports, and whereby said valve sleeve can be moved to open said access ports by controlling the pressure in the tubing string with respect to the shut in pressure of the well to develop an implosion fluid flow from the perforations when said access ports are first opened; and coupling means connecting said valve sleeve to said large piston whereby said valve sleeve can move in conjunction with movement of said large piston, locking means on said coupling mean for releasably locking said valve sleeve against premature opening movement until said large piston has traveled a predetermined distance, said coupling means and said locking means permitting resetting of said valve sleeve to an initial condition.

12. The apparatus as set forth in claim 11 wherein said coupling means includes collet fingers which have lip ends for engaging a window in said valve sleeve and wherein said locking means includes an reduced diameter bore for engaging outer surfaces of said collet fingers.

13. A method for clearing debris from perforations in earth formations traversed by a well bore where the formations contain fluids under pressure and where a tubing string extends to a location proximate to the perforations and is sealed with respect to the bore of the well, said method including the steps of:

disposing a well tool in releasably locked condition in the tubing string with a sealing means located above an implosion valve and where the implosion valve includes a longitudinally extending flow passage;

access ports in said tool for placing said flow passage in fluid communication with the exterior of the tool, a slidable valve sleeve disposed in said flow passage over said access ports and being pressure balanced in said flow passage, where said access ports and said valve sleeve constitute the implosion valve; and further including a large piston and a small piston slidably disposed in bores in said tool where the large piston is cooperable with said valve sleeve and the smaller piston is cooperable with said large piston, said large piston being in fluid communication with said flow passage and said small piston being in fluid communication with the formation pressure below the tool, said large piston and said small piston having an area relationship so that a predetermined tubing pressure with respect to a given shut in pressure can be used in moving said valve sleeve and in opening said access ports; and reducing the pressure in the tubing string a predetermined pressure with respect to the shut in pressure of the well to move said large piston and said small piston so that the shut in pressure is suddenly applied to the valve sleeve to suddenly open the implosion valve.

14. The method as set forth in claim 13 including the steps of determining the shut-in pressure of the fluids in the well bore;

selecting a desired tubing pressure to operate the implosion valve;

selecting a desired area relationship between the large piston and small piston for the selected tubing pressure and shut in pressure and then disposing the well tool in the tubing string and performing the steps of operating the implosion valve.

15. The method as set forth in 13 wherein prior to reducing the pressure in the tubing string, a recording of static pressure in the tubing string and in the well bore is recorded, and wherein when the implosion valve is opened recording the dynamic pressure conditions in the tubing string and in the well bore as a function of time.

* * * * *